US009821989B2

(12) United States Patent
Uhl et al.

(10) Patent No.: US 9,821,989 B2
(45) Date of Patent: Nov. 21, 2017

(54) ADJUSTABLE OVERHEAD ASSEMBLY FOR VEHICLE LIFT

(71) Applicant: VEHICLE SERVICE GROUP, LLC, Madison, IN (US)

(72) Inventors: John E. Uhl, Madison, IN (US); Keith W. Siddall, Madison, IN (US); Ronald J. Schneider, Addyston, OH (US); Jia Liu, Haimen (CN)

(73) Assignee: Vehicle Service Group, LLC, Madison, IN (US)

( * ) Notice: Subject to any disclaimer, the term of this patent is extended or adjusted under 35 U.S.C. 154(b) by 0 days.

(21) Appl. No.: 14/619,202

(22) Filed: Feb. 11, 2015

(65) Prior Publication Data

US 2015/0232308 A1 Aug. 20, 2015

Related U.S. Application Data

(60) Provisional application No. 61/940,589, filed on Feb. 17, 2014.

(51) Int. Cl.

| | |
|---|---|
| ***B66F 3/46*** | (2006.01) |
| ***B66F 7/28*** | (2006.01) |
| ***B66F 7/04*** | (2006.01) |
| ***B66F 7/16*** | (2006.01) |

(52) U.S. Cl.

CPC ..... *B66F 7/28* (2013.01); *B66F 7/04* (2013.01); *B66F 7/16* (2013.01); *Y10T 29/49826* (2015.01)

(58) Field of Classification Search

CPC ..... B66F 7/04; B66F 7/16; B66F 7/28; Y10T 29/4982; Y10T 29/49826

See application file for complete search history.

(56) References Cited

U.S. PATENT DOCUMENTS

| | | | | | |
|---|---|---|---|---|---|
| 4,763,761 | A * | 8/1988 | McKinsey | B66F 7/04 | 187/207 |
| 4,976,336 | A * | 12/1990 | Curran | B66F 7/04 | 187/208 |
| 5,009,287 | A * | 4/1991 | Starr | B66F 7/04 | 187/213 |
| 5,207,296 | A * | 5/1993 | Beattie | B66F 7/04 | 187/208 |
| 5,207,297 | A * | 5/1993 | Beattie | B66F 7/04 | 187/208 |
| 5,211,264 | A * | 5/1993 | Beattie | B66F 7/04 | 187/208 |

(Continued)

*Primary Examiner* — Marc Carlson

(74) *Attorney, Agent, or Firm* — Frost Brown Todd LLC; Matthew Schantz

(57) ABSTRACT

An apparatus for lifting a vehicle comprises at least two posts, at least two lifting assemblies, at least one actuator, and an overhead assembly. The at least two posts are configured to cooperatively raise a vehicle. Each lifting assembly is associated with a corresponding post. The at least two lifting assemblies are configured to move simultaneously to raise a vehicle. The at least one actuator is in communication with the at least two lifting assemblies. The overhead assembly is secured to each of the at least two posts such that the overhead assembly extends from one post to another post. The overhead assembly is selectively movable relative to the at least two posts between a first position and a second position.

15 Claims, 19 Drawing Sheets

(56) References Cited

U.S. PATENT DOCUMENTS

| | | | | | |
|---|---|---|---|---|---|
| 5,318,154 | A * | 6/1994 | Hellman, Jr. | B66F 7/02 | 187/203 |
| 5,727,656 | A * | 3/1998 | Gaudioso | B66F 7/02 | 187/221 |
| 5,803,206 | A * | 9/1998 | Halstead | B66F 7/04 | 187/208 |
| 6,279,685 | B1 * | 8/2001 | Kogan | B66F 7/28 | 187/203 |
| 6,604,610 | B2 * | 8/2003 | Starling | B60B 29/00 | 187/203 |
| 6,866,124 | B1 * | 3/2005 | Barkis | B66F 7/025 | 187/213 |
| 8,414,243 | B2 * | 4/2013 | Stokes | E04H 6/06 | 187/213 |

* cited by examiner

ADJUSTABLE OVERHEAD ASSEMBLY FOR VEHICLE LIFT

PRIORITY

This application claims priority to U.S. Provisional Pat. App. No. 61/940,589, entitled "Adjustable Overhead Assembly for Vehicle Lift," filed Feb. 17, 2014, the disclosure of which is incorporated by reference herein.

BACKGROUND

A vehicle lift is a device operable to lift a vehicle such as a car, truck, bus, etc. Some vehicle lifts operate by positioning arms under the vehicle. The arms may be pivotably coupled with a yoke to support the frame, axle, wheel, or the like of the vehicle. The yoke may be attached to one of two posts. The posts may be fixed in a location on each side of the vehicle. Each yoke may be attached to the posts in such a way that the yokes may actuate up and down on each post relative to the ground. Accordingly, the yokes may be raised or lowered to bring the vehicle to a desired height. Afterward, the vehicle may then be lowered once the user has completed his or her task requiring the vehicle lift. In some cases, the posts for vehicle lift may be affixed to the ground. This fixation to the ground eliminates the need for significant excavation and permits the posts to remain substantially stationary relative to one another at ground level. However, as the vehicle is raised, the weight of the vehicle may tend to force the top of each post toward the other post. In addition or in the alternative, various circumstances may cause one yoke to ascend and/or descend at a different rate relative to another yoke in the same lift. By adding an overhead bar to the top of the posts which spans between the two posts, the posts may remain substantially stationary to one another on both the top and bottom ends of the posts. In addition or in the alternative, the overhead bar may accommodate part of a stabilization system permitting each yoke to communicate lifting force with the other yoke. However, the overhead bar may limit the workspaces suitable for installing the vehicle lift because of variation in ceiling or fixture heights.

Further examples of such vehicle lift devices and related concepts are disclosed in U.S. Pat. No. 6,983,196, entitled "Electronically Controlled Vehicle Lift and Vehicle Services System," issued Jan. 3, 2006, the disclosure of which is incorporated by reference herein; U.S. Pub. No. 2011/0097187, entitled "Vehicle Guidance System for Automotive Lifts," published Apr. 28, 2011, the disclosure of which is incorporated by reference herein; U.S. Pat. No. 5,009,287, entitled "Vehicle Lift," issued Apr. 23, 1991, the disclosure of which is incorporated by reference herein; U.S. Pat. No. 6,964,322, entitled "Method and Apparatus for Synchronizing a Vehicle Lift," issued Nov. 15, 2005, the disclosure of which is incorporated by reference herein; U.S. Pat. No. 7,150,073, entitled "Hinge Pin," issued Dec. 19, 2006, the disclosure of which is incorporated by reference herein; and U.S. Pub. No. 2004/0011594, entitled "Overhead Assembly for Vehicle Lift," published Jan. 22, 2004, the disclosure of which is incorporated by reference herein.

While a variety of vehicle lifts have been made and used, it is believed that no one prior to the inventor(s) has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
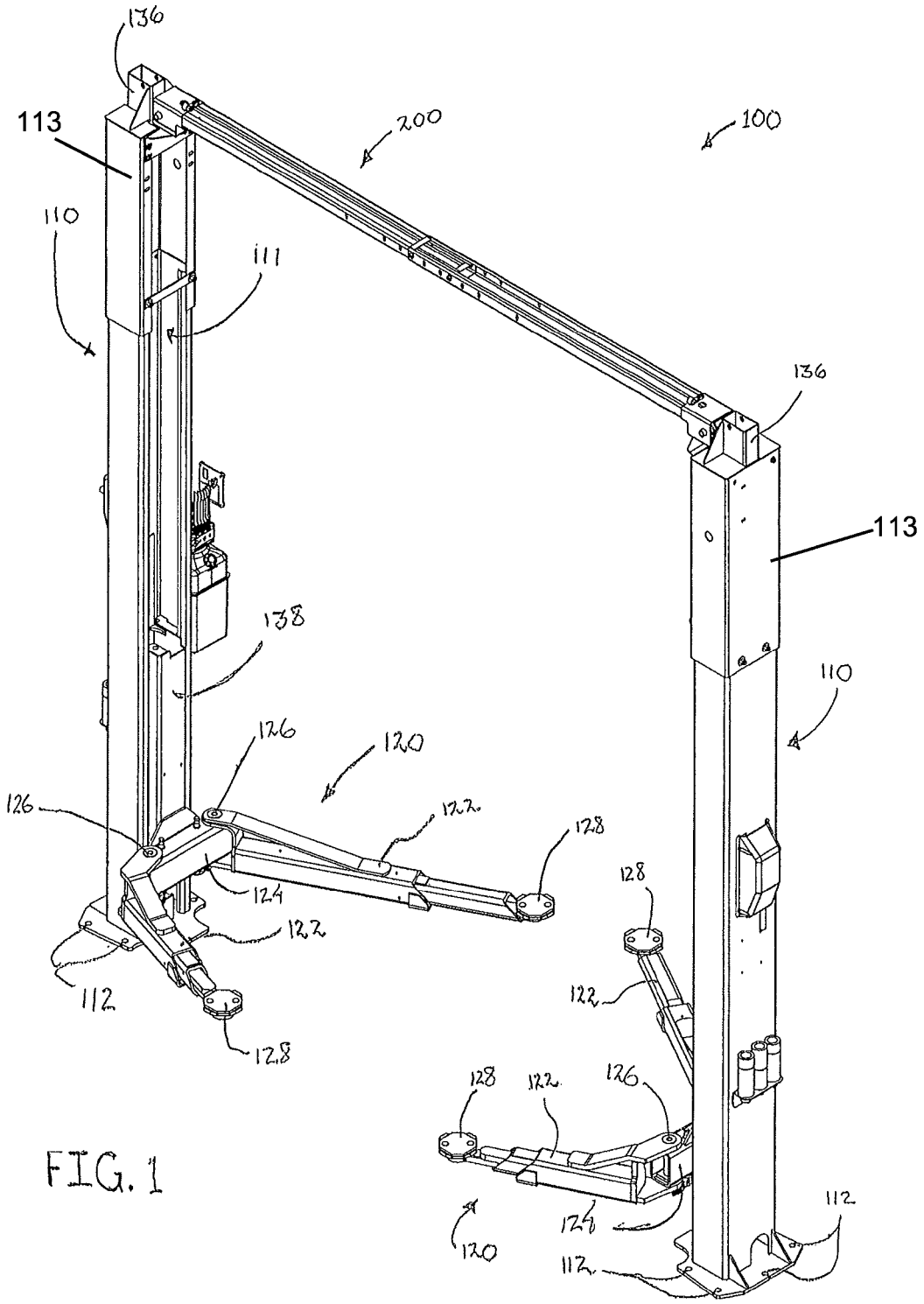
FIG. 1 depicts a perspective view of an exemplary vehicle lift system with an overhead assembly in a first vertical position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

FIG. 1 shows a vehicle lift system (100). Vehicle lift system (100) comprises two posts (110), two corresponding carriage assemblies (120), and an overhead bar assembly (200). Posts (110) are configured to be mounted to the ground by bolts disposed through bolt holes (112) located on the bottom of each post (110). Posts (110) then extend vertically from the ground. As can be seen, posts (110) generally have a rectangular transverse cross section with a channel (111) in one side. The rectangular shape of posts (110) makes posts (110) substantially rigid. The channel (111) in one side of the cross-section of posts (110) permits carriage assemblies (120) to engage internal hydraulic cylinder assemblies (130), as will be described in greater detail below. In the present example, each post (110) has a vertical extension (113) secured to the top of post (110). Such extensions (113) may be added to increase the effective height of each post (110). Alternatively, such extensions (113) may be omitted if desired. It should be understood that use of the term "post" herein is intended to include an assembly formed by post (110) with extension (113) and versions of post (110) without extension (113). It should also be understood that the vertical position of each extension (113) along each post (110) may be selectively adjusted to thereby selectively adjust the effective height of each post (110).

Carriage assemblies (120) are shown has having two arms (122) extending from posts (110) at an angle. The two arms (122) of each carriage assembly (120) are connected to one another by a yoke (124). The proximal end of each arm (122) may connect to yoke (124) by a pin connection (126). Pin connection (126) may permit arms (122) to rotate relative to yoke (124). The distal end of each arm (122) is shown as having a lifting pad (128). Lifting pad (128) is configured to support a vehicle. The rotatability of arms (122) about yoke (124) permits each lifting pad (128) to be adjusted to a location on vehicle suitable for lifting such as the frame, axle, or wheel. Arms (122) may be formed by telescoping segments that provide adjustability of the effective length of each arm (122). Thus, the combination of arms (122) being rotatable relative to yoke (124) and the telescoping nature of the arm segments permits vehicle lift system (100) to lift vehicles of varying size, shape, and/or lifting locations.

Figure 2:
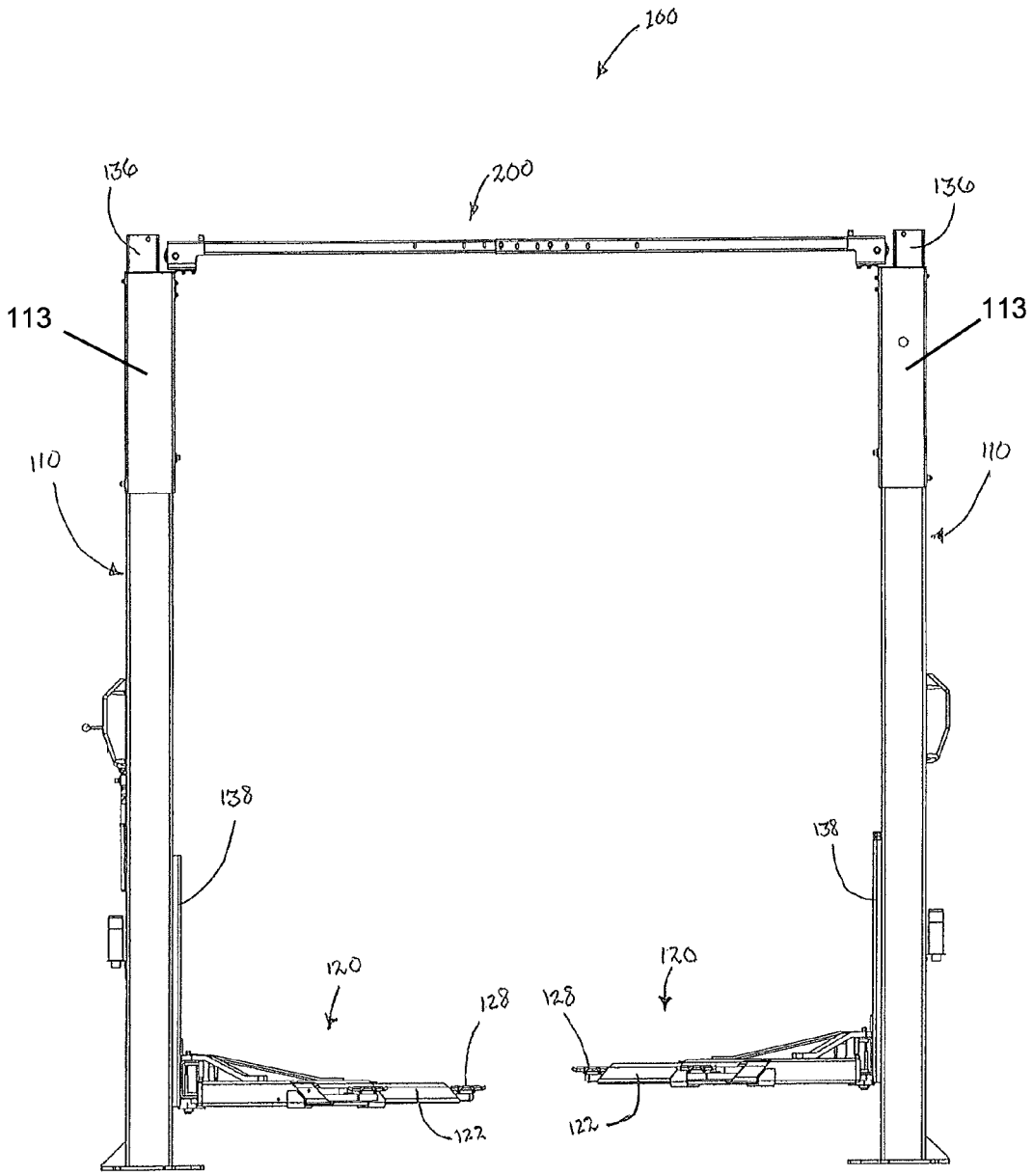
FIG. 2 depicts a front view of the vehicle lift system of FIG. 1.

As can be seen in FIG. 2, posts (110) are aligned to be substantially parallel to each other. The alignment of posts (110) may be maintained by bolts in bolt holes (112). Similarly, the parallel alignment of posts (110) may be maintained by overhead bar assembly (200) mounted on the upper portion of posts (110). Thus, even when a vehicle is supported by arms (122) of carriage assemblies (120), posts (110) may maintain parallel alignment whether carriage assemblies (120) are positioned in a lowered position or raised position relative to the ground. As will be discussed in greater detail below, overhead bar assembly (200) also provides suitable structure to mount sheave assemblies (260) that are used for an equalization system which stabilizes and levels the carriage assembly (120) on each post (110).

Figure 3:
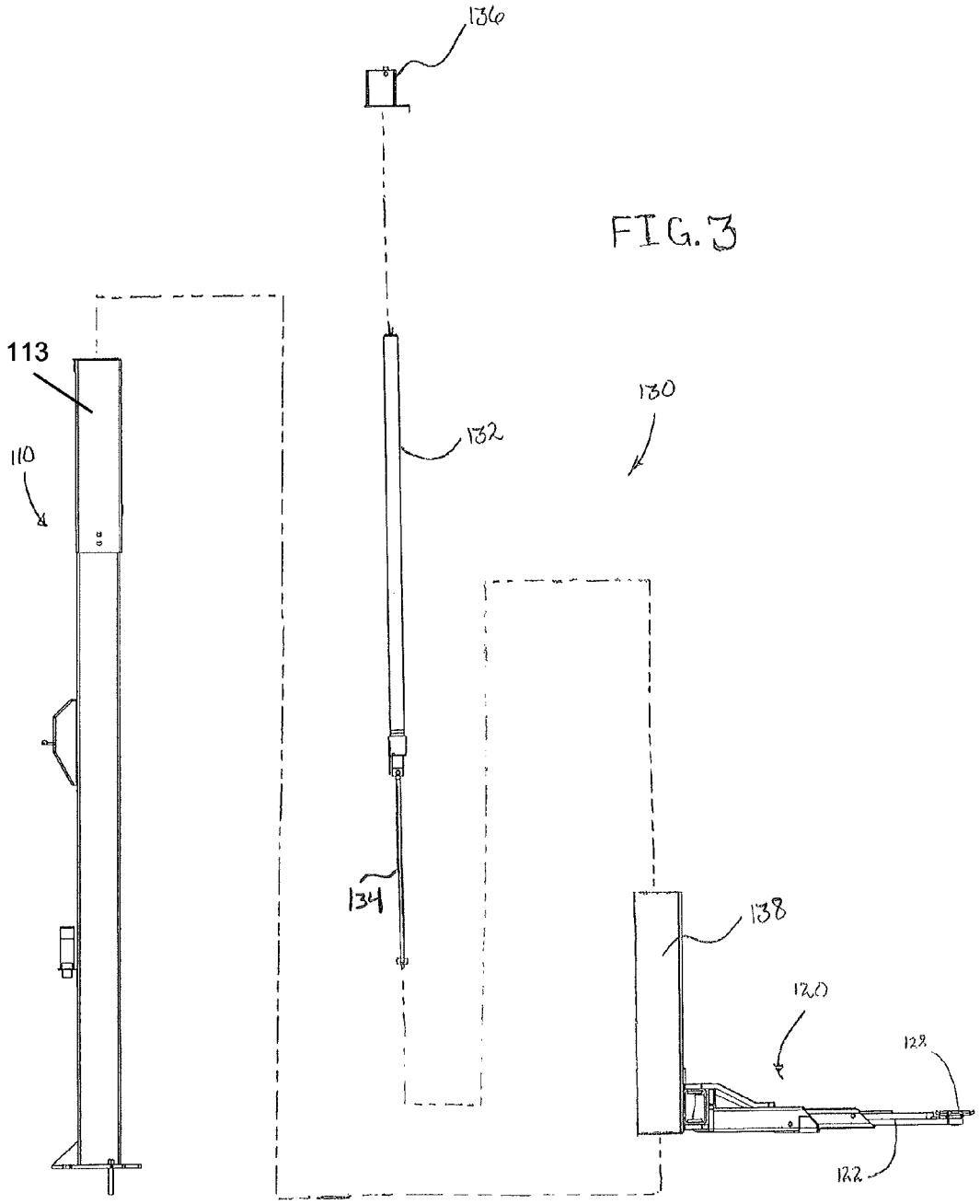
FIG. 3 depicts a front exploded view of a post assembly of the vehicle lift system of FIG. 1.

As described above, carriage assemblies (120) may be engaged by hydraulic cylinder assembly (130) mounted inside posts (110). FIG. 3 shows an exploded view of a merely exemplary hydraulic cylinder assembly (130). In the present example, hydraulic cylinder assembly (130) shown as a pull-type hydraulic cylinder assembly (130). Hydraulic cylinder assembly (130) comprises a hydraulic cylinder (132), a rod (134), a cylinder bracket assembly (136), and a carriage (138). Rod (134) includes an integral piston (not shown) that is slidably disposed in hydraulic cylinder (132). Hydraulic cylinder (132) is configured to pull rod (134) via piston (not shown) in an upward direction, toward the top of post (110). Cylinder bracket (136) is configured to attach hydraulic cylinder (132) to the top of post (110). For instance, a pin or other fastening feature may be disposed through complementary openings formed through cylinder bracket (136) and hydraulic cylinder (132). It should also be understood that cylinder bracket (136) may be secured directly to the top of post (110) and/or directly to the top of extension (113).

Carriage (138) is configured to attach to rod (134). For instance, the free end of rod (134) may be disposed through an opening in carriage (138), with a nut or some other fastening feature securing the free end of rod (134) to carriage (138). When inside post (110), carriage (138) is configured to slide within post (110) by any suitable means such as a linear slide. Thus, carriage (138) may be actuated within post (110) by hydraulic cylinder (132) pulling carriage (138) upwardly. As will be described in greater detail below, the top of carriage (138) in one post (110) may be coupled with the bottom of carriage (138) in another post (110) via cable (not shown), which runs through sheaves (260). Similarly, the top of the latter carriage (138) may be coupled with the bottom of the former carriage (138) via cable (not shown). This arrangement permits the force applied by each hydraulic cylinder (132) to be distributed between the carriages (138) where an uneven load may be applied to the vehicle lift system (100).

As can be seen in FIG. 3, carriage assembly (120) may attach to carriage (138). Thus, when a vehicle is properly positioned relative to carriage assemblies (120), the vehicle may be raised relative to post (110) by the actuation of carriage (138).

Figure 4:
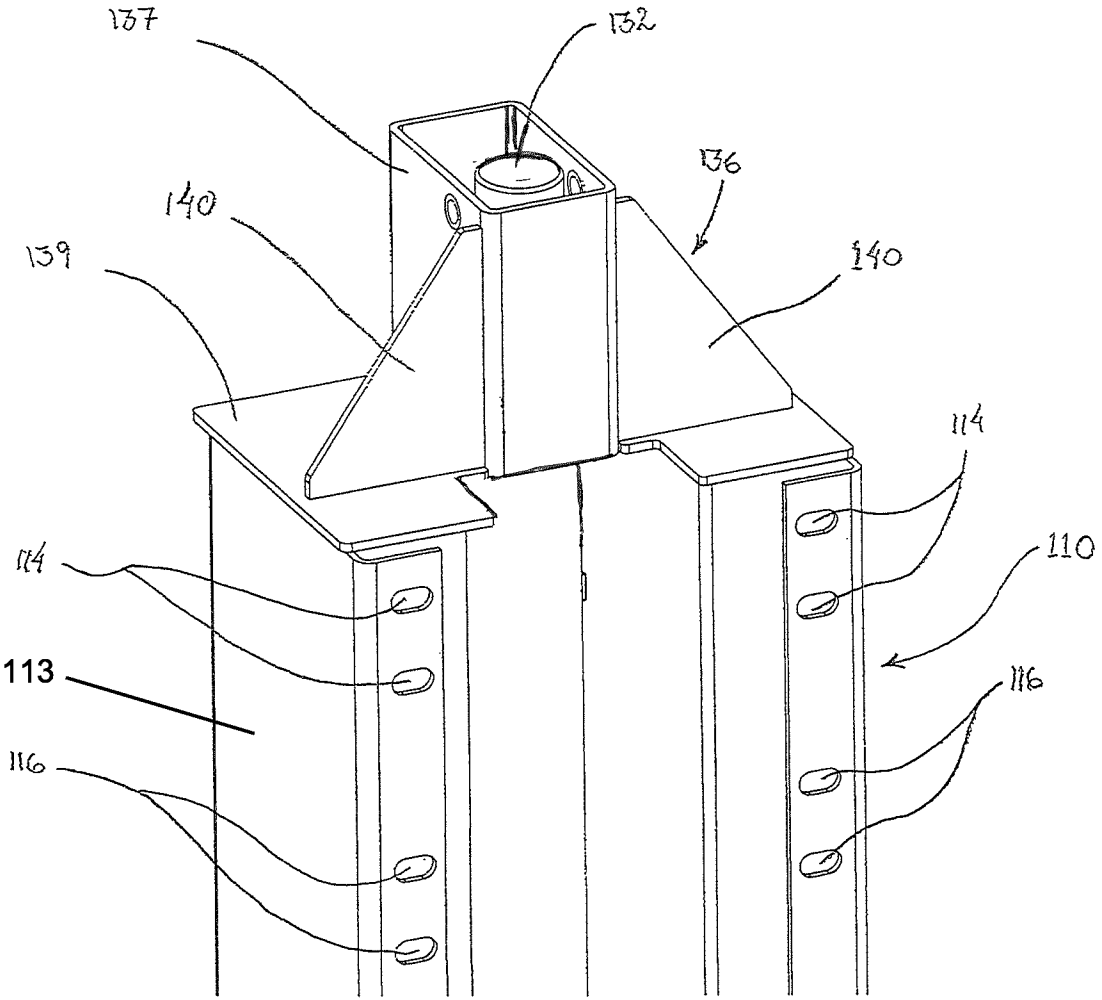
FIG. 4 depicts a partial perspective view of an upper end of the post assembly of FIG. 3.

FIG. 4 shows a detailed perspective view of post (110), hydraulic cylinder (132), and cylinder bracket assembly (136). Cylinder bracket assembly (136) rests atop the upper end of post (110). Cylinder bracket assembly (136) includes a cylinder bracket (137), a base (139), and two stabilizing plates (140). Cylinder bracket (137) is configured to securely affix hydraulic cylinder (132) to the upper end of post (110). Cylinder bracket (137) may secure hydraulic cylinder (132) by any suitable means of mechanical fastening such as bolting, pin connection, or any other suitable mechanical fastener as will be apparent to those of ordinary skill in the art in view of the teachings herein.

Cylinder bracket (137) is connected to base (139) of cylinder bracket assembly (136). Base (139) and cylinder bracket (137) may be of unitary construction or may be separate parts (e.g., welded together, etc.). Base (139) securely fastens cylinder bracket assembly (136) to the upper end of post (110) and transfers load to post (110) by resting on top of the upper end of post (110). Base (139) may be secured to post (110) by any suitable means such as welding, bolting or the like. To add additional stability to cylinder bracket assembly (136), two stabilizing plates (140) connect base (139) to cylinder bracket (137). Although stabilizing plates (140) are shown as triangular in shape, they may be of any suitable shape. Additionally, other examples may include more or less stabilizing plates (140), or even omit stabilizing plates (140) entirely. Other suitable configurations for cylinder bracket assembly (136) will be apparent to those of ordinary skill in the art in view of the teachings herein.

Figure 5:
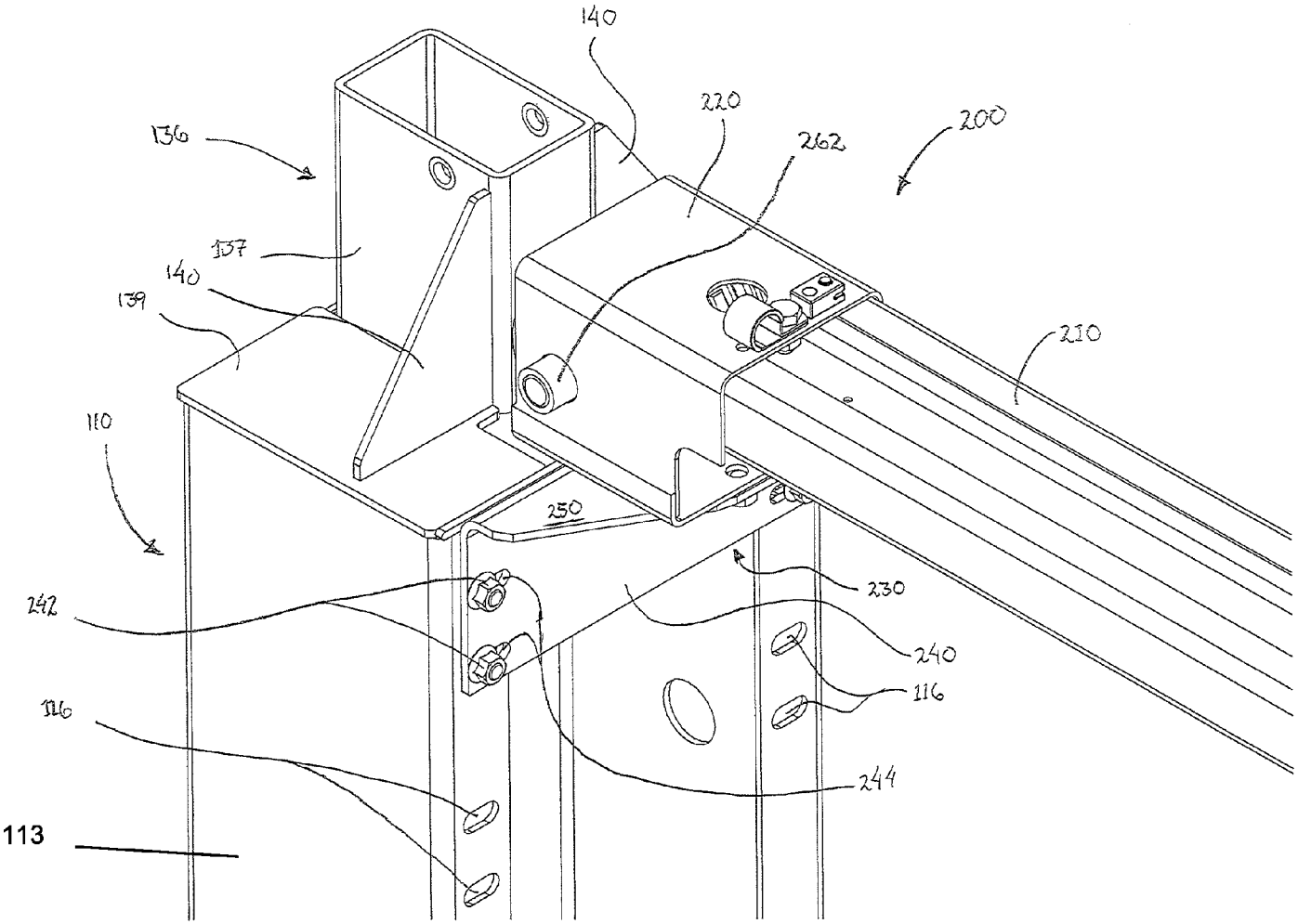
FIG. 5 depicts a partial perspective view of an overhead bar assembly secured to the upper end of FIG. 4, in the first vertical position.

Cylinder bracket (136) is configured to accommodate overhead bar assembly (200). As can be seen in FIG. 5, overhead bar assembly (200) may be attached to the top of post (110) adjacent to cylinder bracket (136). Overhead bar assembly (200) comprises overhead bar (210), L-bracket (220), and overhead bracket (230). Overhead bar (210) extends from one post (110) to another post (110). As described above, this connection may maintain the posts (110) in parallel alignment as a vehicle is raised using the vehicle lift system (100). It should be understood that overhead bar (210) may be comprised of one unitary component or may be a series of bars welded or bolted together. Other suitable overhead bar (210) configurations will be apparent to those of ordinary skill in the art in view of the teachings herein.

L-bracket (220) provides a connection between overhead bar (210) and overhead bracket (230). In the present example, L-bracket (220) is depicted as having an L-shape. Although it should be understood that L-bracket (220) may have any other shape suitable to connect overhead bar (210) to overhead bracket (230). L-bracket (220) connects to overhead bar (210) and overhead bracket (230) by a nut and bolt mechanical fastening means. In other examples, different fastening means may be used. For instance, L-bracket (220) could be welded to overhead bar (210) and/or overhead bracket (230). Yet in other examples, L-bracket (220) may be of an integral design with overhead bar (210) and/or overhead bracket (230). Still in other examples, L-bracket (220) may be omitted entirely. Various other examples of L-bracket (220) shape and/or attachment means will be apparent to those of ordinary skill in the art in view of the teachings herein.

Figure 6:
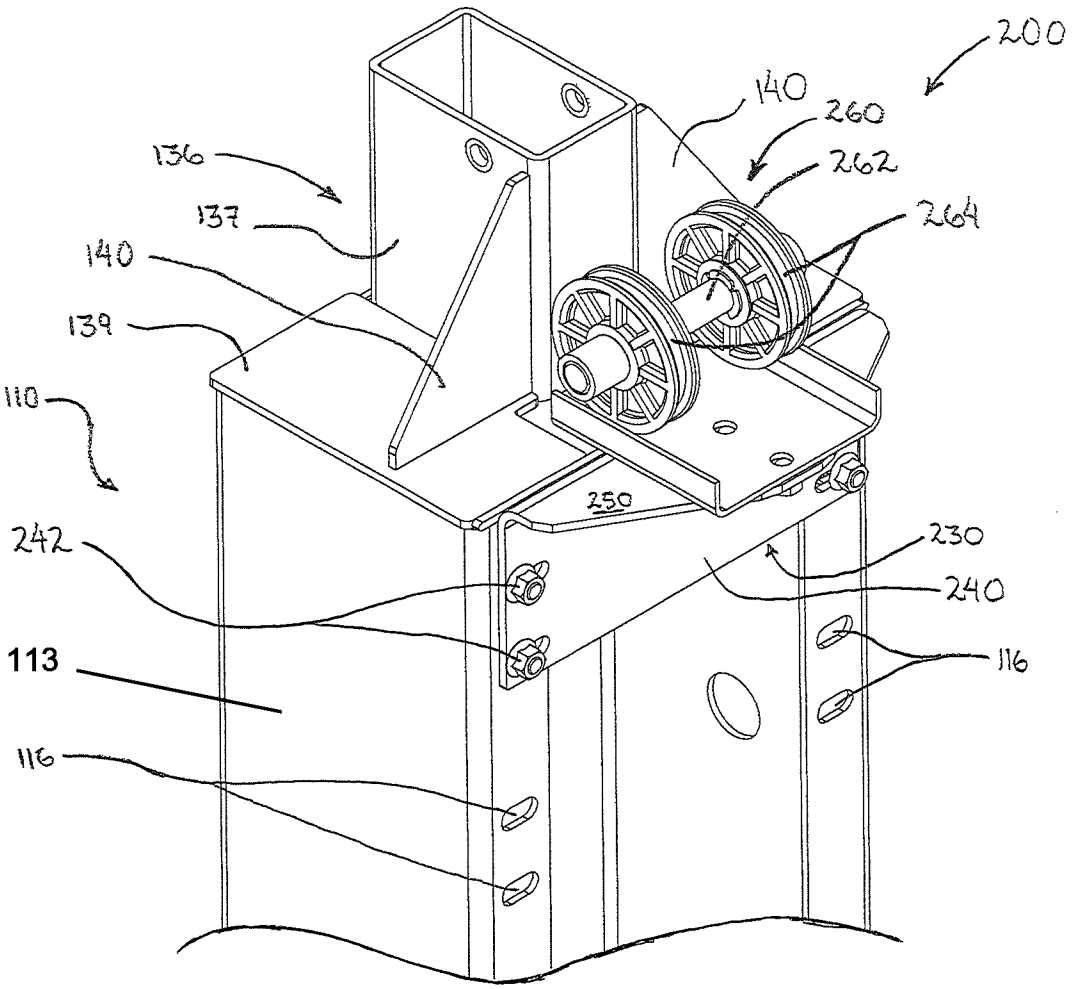
FIG. 6 depicts a partial perspective view of an overhead bar assembly with an L-bracket removed.
Figure 7:
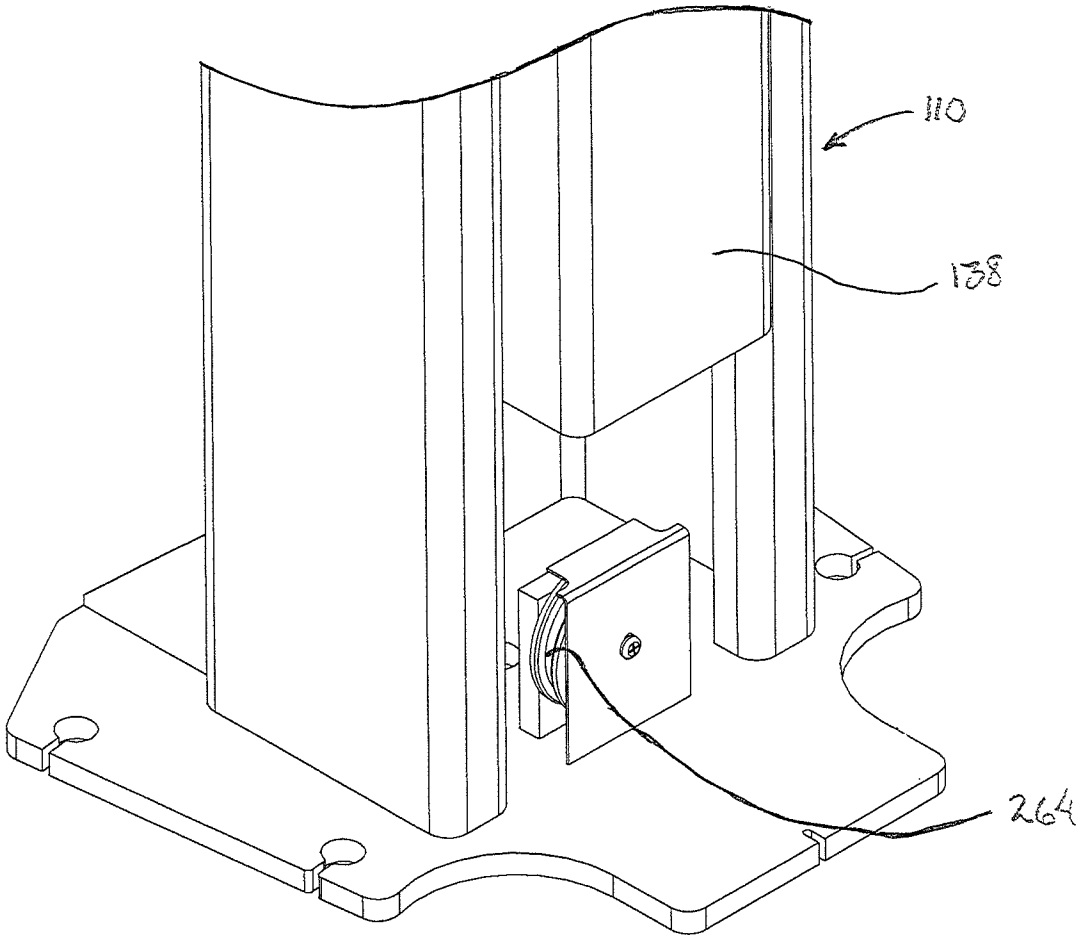
FIG. 7 depicts a partial perspective view of the base of a post with a carriage assembly removed.

As described above, overhead bar assembly (200) provides structural support for sheave assemblies (260), which are a part of a stabilization system. In particular, L-bracket (220) may have a hole permitting mounting of an axle (262) of a sheave assembly (260). FIG. 6 shows a perspective view of overhead bar assembly (200) with overhead bar (210) and a portion of L-bracket (220) removed. With L-bracket (220) removed it may be seen that two sheaves (264) may be attached to axle (262) of sheave assembly (260). Each sheave (264) may be equipped with a cable (not shown) which may run from inside post (110), through the length of overhead bar (210) and to a corresponding sheave (264) on the adjacent post (110). As can be seen in FIG. 7, the base of post (110) provides another sheave (264) mounted thereto. Sheave (264) of post (110) may receive cable (not shown) from each sheave (264) mounted to L-bracket (220). It should be understood that in this arrangement cable (not shown) substantially forms a loop. To stabilize the carriage assemblies (120) on each post (110), each carriage assembly (120) is mounted to one end of the loop formed by cable (not shown). Thus, when a non-uniform load is applied relative to the two carriage assemblies (120), the load is stabilized by cable (not shown) transferring lifting force (applied by hydraulic cylinder (132)) from the carriage assembly (120) carrying less load to the carriage assembly (120) carrying more load. Moreover, when one carriage assembly (120) leads the other carriage assembly (120) in ascent, the leading carriage assembly (120) assists in raising the lagging carriage assembly (120) via the stabilization system, such that the carriage assemblies (120) remain substantially level with each other. It should therefore be understood that the stabilization system may compensate for lateral load imbalances and/or keep carriage assemblies (120) at the same height relative to each other before, during, and after ascent/descent.

Figure 8:
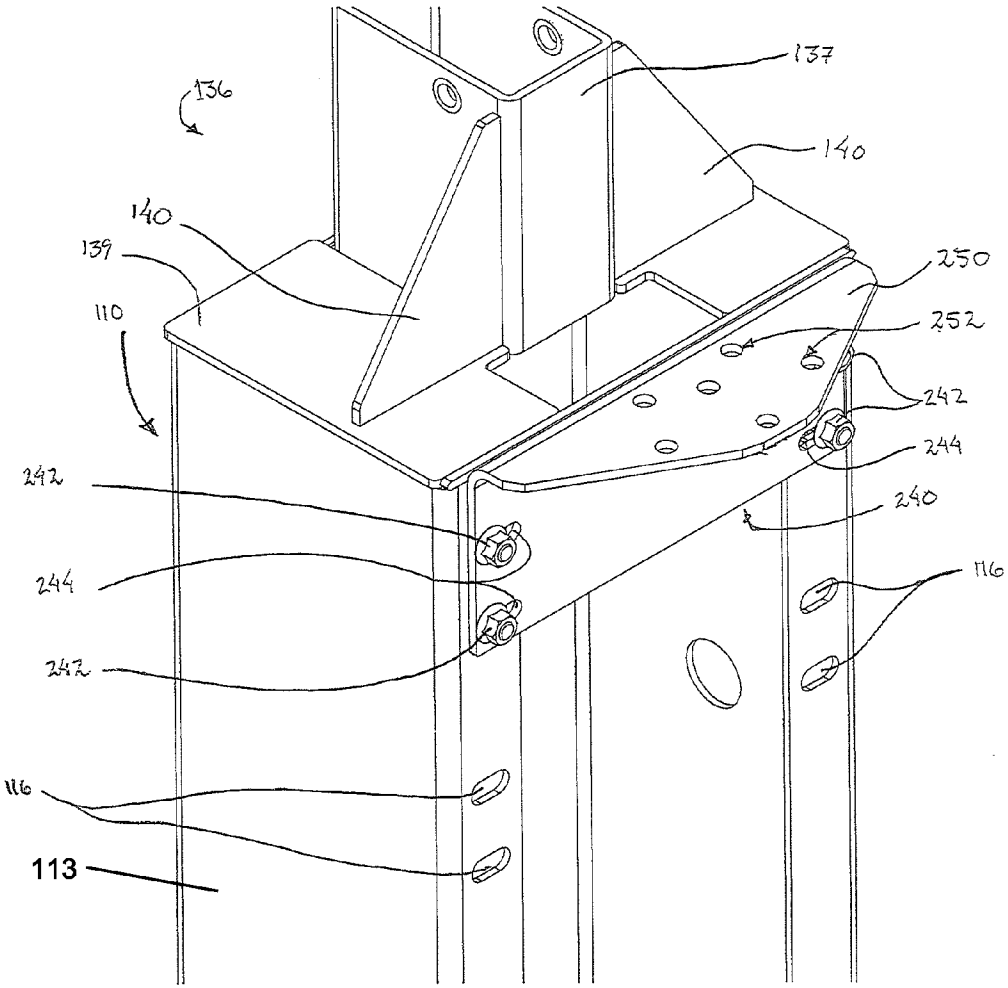
FIG. 8 depicts a partial perspective view of an overhead bracket of the overhead bar assembly of FIG. 5 secured to the upper end of FIG. 4, in the first vertical position.

Overhead bracket (230), as can best be seen in FIG. 8, attaches overhead bar (210) and L-bracket (220) to post (110). Overhead bracket (230) comprises an attachment member (240) and a support member (250). Attachment member (240) has a rectangular shape and is configured to attach to post (110). In particular, attachment member (240) may attach to post (110) by four bolts (242) and four corresponding elongated bolt holes (244). While bolt holes (244) are described as "elongated" in the present example, it should be understood that bolt holes (244) may have any other suitable configuration, including but not limited to circular. As will be described in greater detail below, post (110) has an upper set (114) and a lower set (116) of elongated bolt holes, with each set (114, 116) corresponding to the arrangement of elongated bolt holes (244) of attachment member (240).

Support member (250) of overhead bracket (230) extends perpendicularly and unitarily from attachment member (240) of overhead bracket (230). As support member (250) extends perpendicularly, support member (250) tapers and forms a shape approximating a triangle. In other versions, support member (250) may have any other suitable shape as may be apparent to one of ordinary skill in the art in view of the teachings herein. Support member (250) is shown as having an array of holes (252). Holes (252) permit attachment of L-bracket (220) to overhead bracket (230) by means described above. Although holes (252) are shown as being arranged in a particular pattern, no such limitation is intended. Indeed, holes (252) may be arranged in an array of any suitable arrangement. Alternatively, holes (252) may be omitted (e.g., when support member (250) and L-bracket (220) are welded together or unitarily formed together, etc.).

Figure 9:
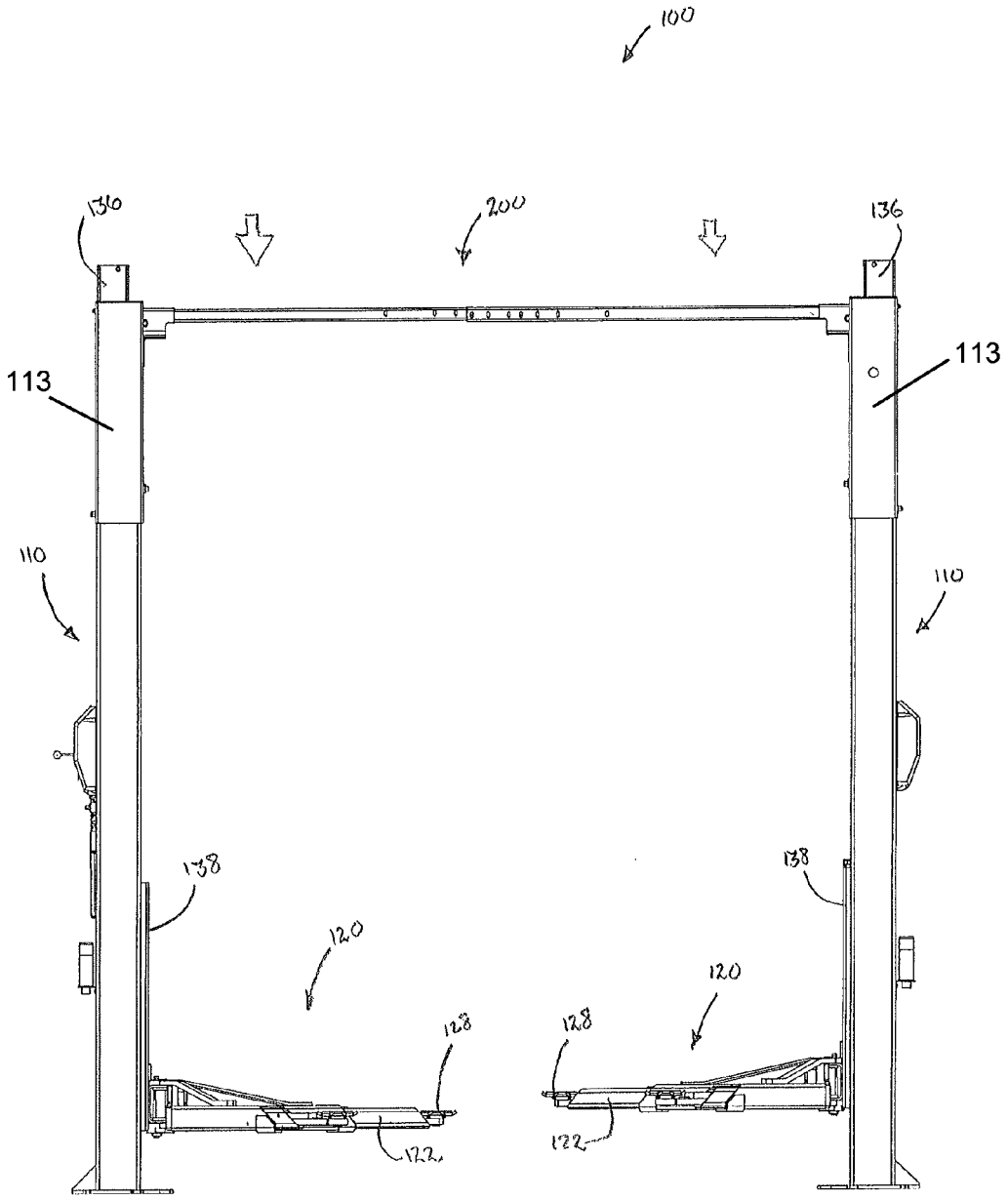
FIG. 9 depicts a front view of the vehicle lift system of FIG. 1 with the overhead assembly in a second vertical position.

As described above, post (110) has an upper set (114) and a lower set (116) of elongated bolt holes. This arrangement may permit overhead bracket (230) to be attached to post (110) at two separate locations. Thus, overhead bar assembly (200) may have two separate vertical positions along post (110). For instance, FIG. 9 shows the vehicle lift system with overhead bar assembly (200) in a lower position. With overhead bar assembly (200) in the lower position, vehicle lift system may be installed in environments having lower ceiling clearances. While bolt holes (114, 116) are described as "elongated" in the present example, it should be understood that bolt holes (114, 116) may have any other suitable configuration, including but not limited to circular.

Figure 10:
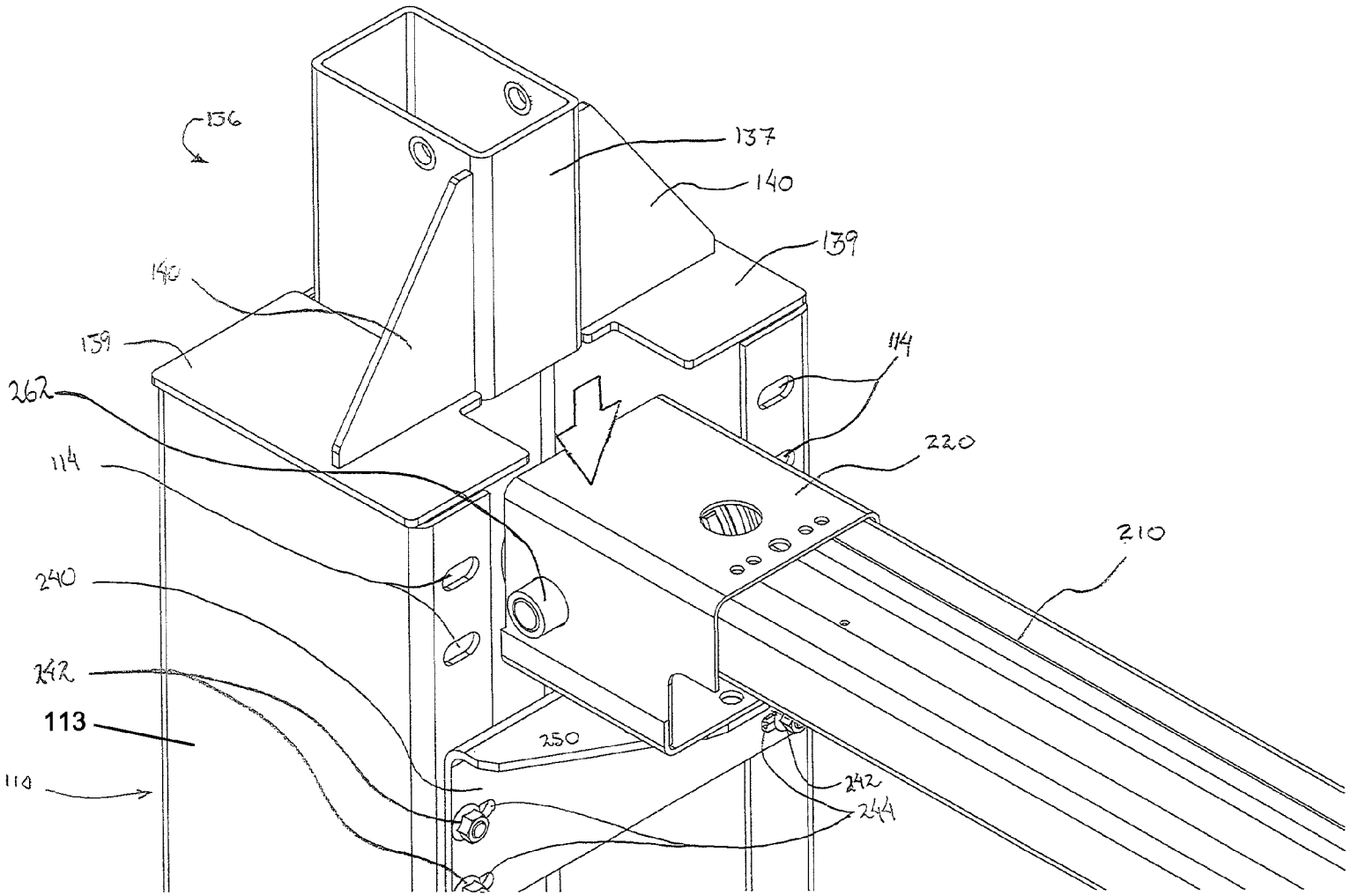
FIG. 10 depicts a partial perspective view of the overhead bar assembly secured to the upper end of FIG. 4, in the second vertical position.
Figure 11:
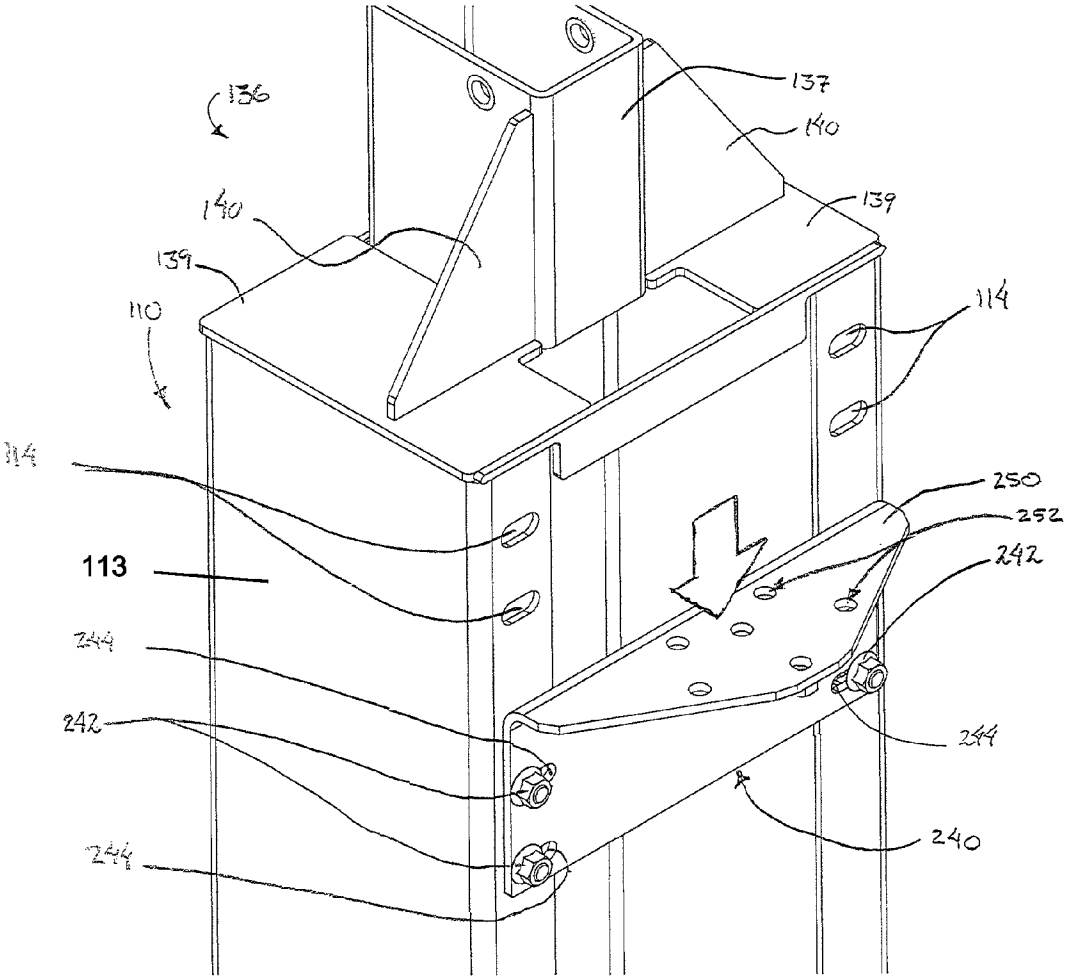
FIG. 11 depicts a partial perspective view of the overhead bracket of the overhead bar assembly of FIG. 5 secured to the upper end of FIG. 4, in the second vertical position.

FIG. 10 shows overhead bar assembly (200) mounted on post (110) in the lower position. Similarly, FIG. 11 shows only attachment member (240) mounted on post (110) in the lower position. As can be seen in FIG. 10, the top of overhead bar (210) is below cylinder bracket (136) when overhead bar assembly (200) is mounted in the lower position. Similar to the arrangement described above with respect to FIG. 5, overhead bracket (230) is attached to post (110) using bolts (242). In this instance, however, bolts (242) align elongated bolt holes (244) of attachment member (240) with lower set (116) of elongated bolt holes of post (110).

In the present example, post (110) is configured with two mounting positions for overhead bar assembly (200). It should be understood that in other examples, additional mounting positions may be provided. For instance, a third position may be provided below the lower position shown in FIG. 11. Yet in other examples, a series of elongated bolt holes (114, 116) may be provided on post (110) with each bolt hole evenly spaced longitudinally on post (110) such that overhead bracket (230) may be mounted on elongated bolt holes (114, 116) without reference to a particular set. Other alternative arrangement of elongated bolt holes (114, 116) on post (110) or alternative heights of overhead bar assembly (200) will be apparent to those of ordinary skill in the art in view of the teachings herein.

Although overhead bar assembly (200) is shown as using four bolts (242) to attach to post (110), it should be understood that any suitable mechanical fastening means and/or any number of bolts (242) may be used. By way of example only, two bolts (242) may be used instead of four. Yet in other examples, bolts (242) may be substituted for another mechanical attachment means such as threaded screws, rivets, clamps, and/or the like. Other suitable means of attaching overhead bar assembly (200) to post (110) will be apparent to one of ordinary skill in the art in view of the teachings herein.

Figure 12:
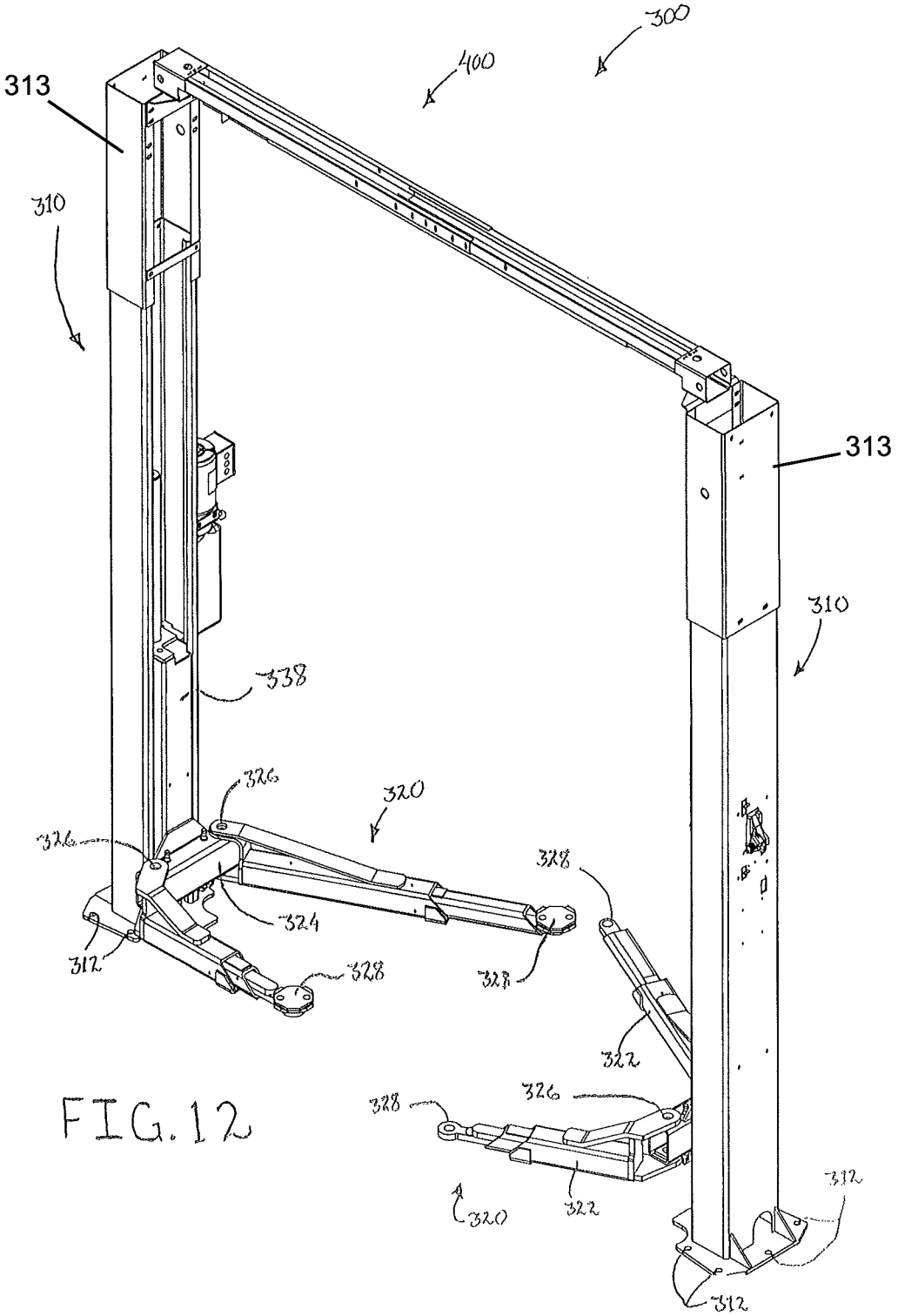
FIG. 12 depicts a perspective view of an exemplary alternative vehicle lift system, with an overhead bar assembly in a first vertical position.

FIG. 12 depicts an alternative vehicle lift system (300). Similar to vehicle lift system (100) above, vehicle lift system (300) comprises two posts (310), two corresponding carriage assemblies (320), and an overhead bar assembly (400). These components are substantially the same, and have substantially the same function, as those described above. For instance, each post (310) has a vertical extension (313) secured to the top of post (310). It should be understood that use of the term "post" herein is intended to include an assembly formed by post (310) with extension (313) and versions of post (310) without extension (313). However, unlike list system (100), hydraulic cylinder assembly (330) contained within post (310) of lift system (300) is a push-type hydraulic cylinder assembly (330) rather than a pull-type hydraulic cylinder assembly (130) of vehicle lift system (100).

Figure 13:
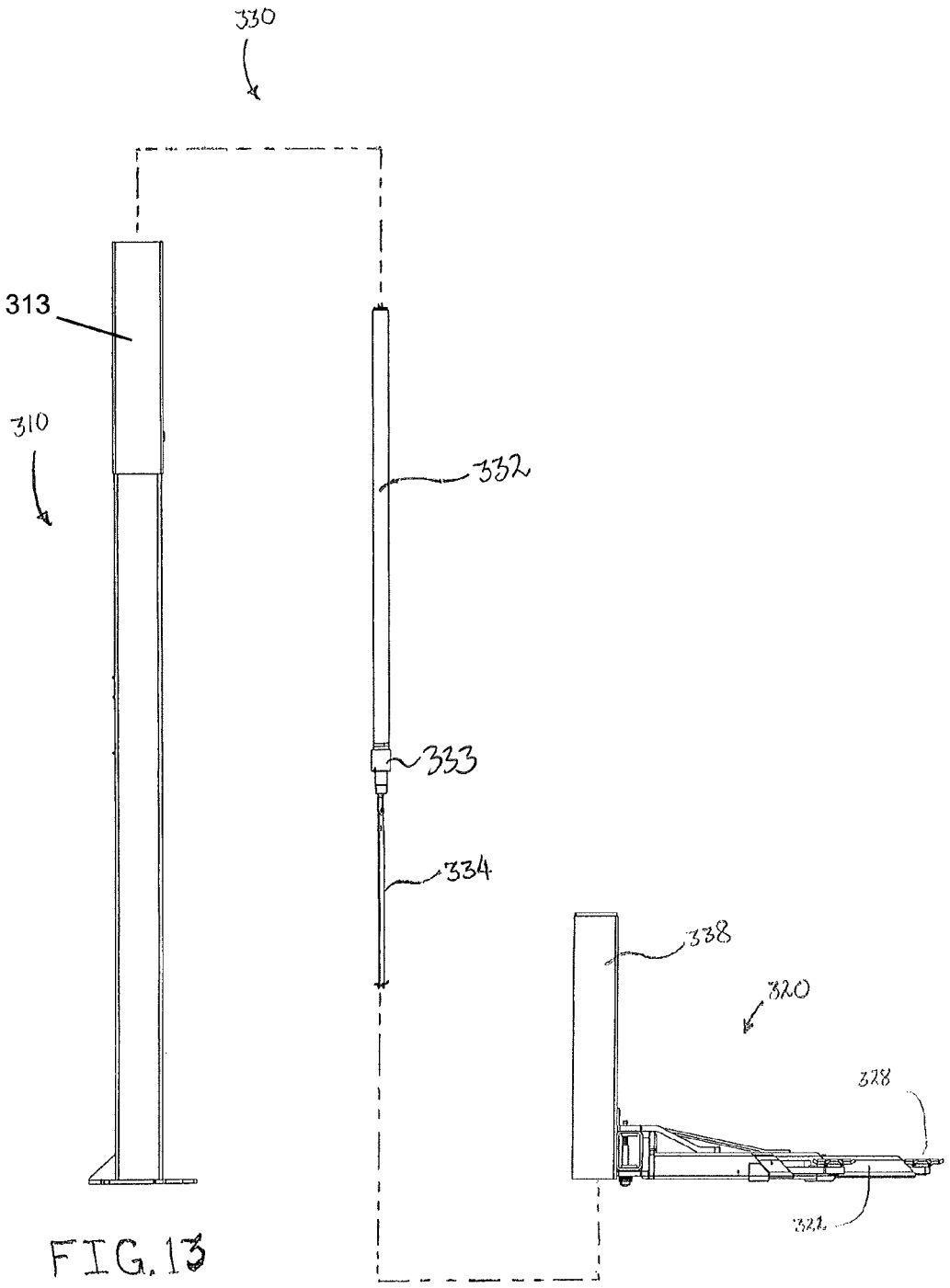
FIG. 13 depicts a front exploded view of a post assembly of the vehicle lift system of FIG. 12.

FIG. 13 shows an exploded view of hydraulic cylinder assembly (330) of vehicle lift system (300). Hydraulic cylinder assembly (330) comprises a hydraulic cylinder (332), a rod (334), and a carriage (338). Hydraulic cylinder (332) includes an integral mounting ring (333), which is unitarily secured to hydraulic cylinder (332). The free end of rod (334) is secured to the bottom of post (310). For instance, the free end of rod (334) may be disposed in an opening formed in the base plate of post (310). Carriage (338) is secured to hydraulic cylinder (332) via mounting ring (333). Similar to carriage (138) of vehicle lift system (100), carriage (338) is configured to actuate vertically within post (310). Thus, as rod (334) reciprocates in relation to hydraulic cylinder (332), carriage (338) may be actuated up and down relative to post (310). In other words, hydraulic cylinder (332) and carriage (338) vertically reciprocate together relative to post (310) Like with carriage (138) of vehicle lift system (100), carriage (338) is attached to carriage assembly (320). Thus, when a vehicle is properly positioned relative to carriage assembly (320), the vehicle may be raised relative to post (310) by the actuation of carriage (338).

Figure 14:
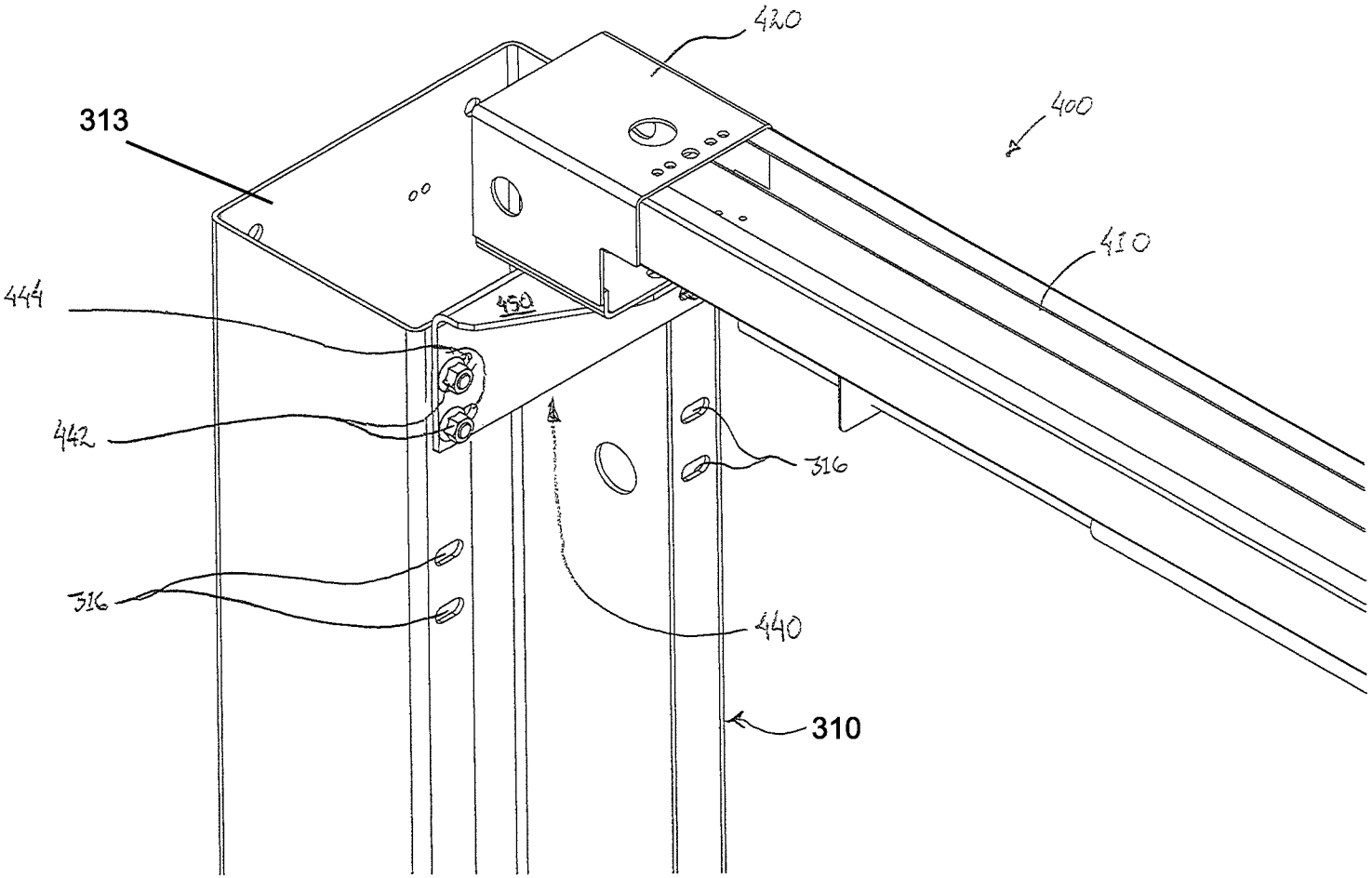
FIG. 14 depicts a partial perspective view of an overhead bar secured to an upper end of the post assembly of FIG. 13, in the first vertical position.
Figure 15:
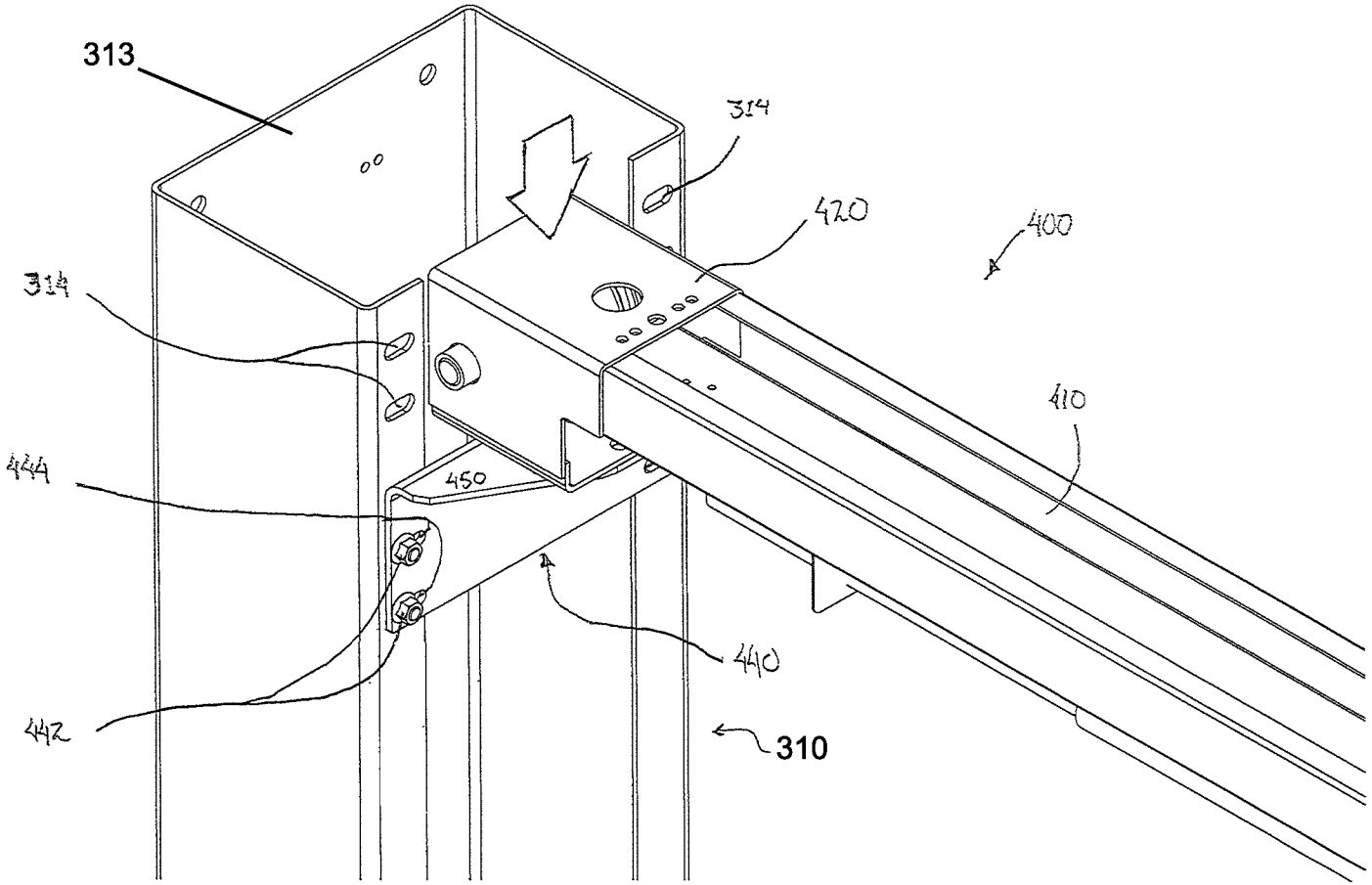
FIG. 15 depicts a partial perspective view of the overhead bar assembly secured to the upper end of FIG. 14, in a second vertical position.

FIGS. 14 and 15 show a detailed perspective view of overhead bar assembly (400) attached to post (310) in an upper and lower position, respectively. Overhead bar assembly (400) comprises overhead bar (410), L-bracket (420), and overhead bracket (230). These components are substantially the same as those discussed above with respect to vehicle lift system (100). However, unlike vehicle lift system (100), alternative vehicle lift system (300) has no cylinder bracket on the end of post (310) because hydraulic cylinder (332) is mounted in the base of post (310). Notwithstanding this difference, overhead bar assembly (400) may still be mounted to post (310) (e.g., to extension (313) of post (310)) in substantially the same way as with overhead bar assembly (200) of vehicle lift system (100) discussed above.

Figure 16:
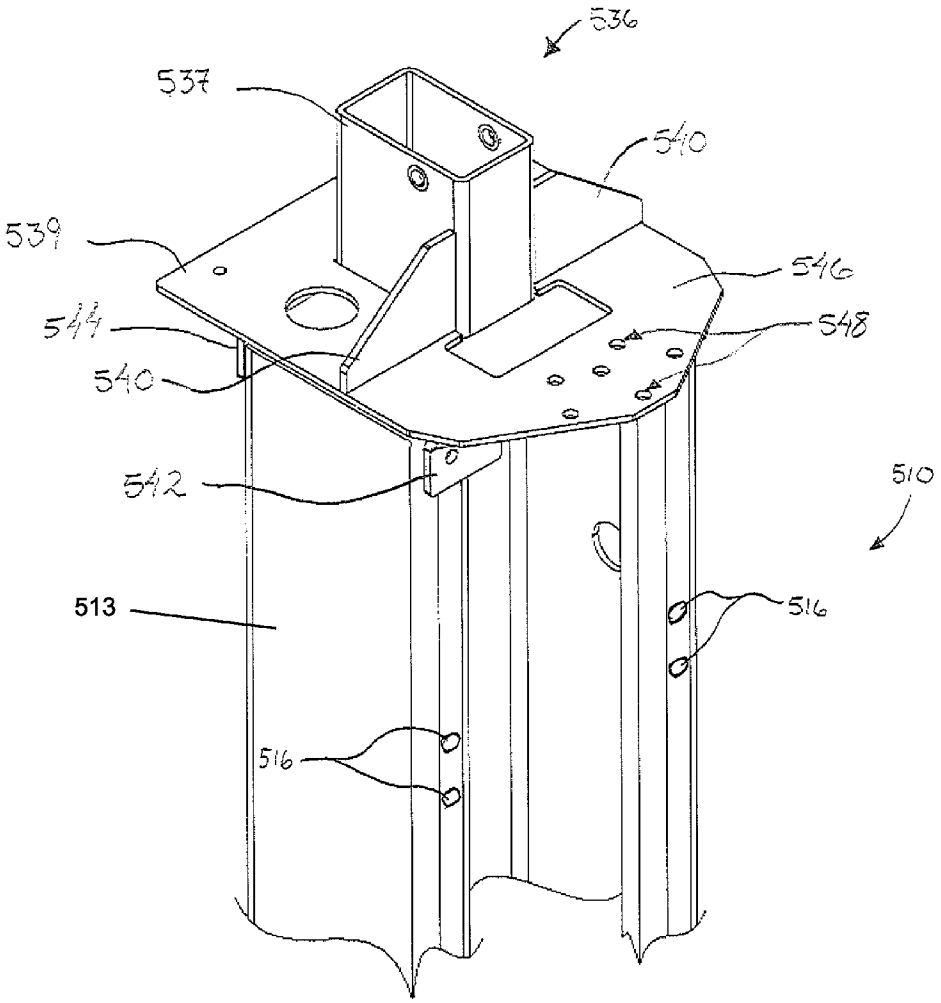
FIG. 16 depicts a perspective view of an exemplary alternative post for use with the vehicle lift systems of FIGS. 1 and 12.

FIG. 16 shows an exemplary alternative post (510) that may be used with vehicle lift systems (100, 300) described above. It should be understood that except as otherwise noted herein, post (510) is substantially the same as posts (110, 310) described above. For instance, each post (510) has a vertical extension (513) secured to the top of post (510). It should be understood that use of the term "post" herein is intended to include an assembly formed by post (510) with extension (513) and versions of post (510) without extension (513). As can be seen, post (510) comprises a plurality of elongated bolt holes (516) and a cylinder bracket assembly (536). Bolt holes (516) are similar to bolt holes (116) described above in that bolt holes (516) are configured to receive corresponding bolts (642) to support an overhead bar assembly (600), as will be described in greater detail below.

Cylinder bracket assembly (536), like cylinder bracket assembly (136), rests atop the upper end of post (510). Cylinder bracket assembly (536) includes a cylinder bracket (537), a base (539), and two stabilizing plates (540). Cylinder bracket (537) is configured to securely affix a hydraulic cylinder (not shown) to the upper end of post (510) when post is used in conjunction with a vehicle lift system such as vehicle lift system (100) described above. It should also be understood that cylinder bracket (537) may be secured directly to the top of post (510) and/or directly to the top of extension (513).

Figure 17:
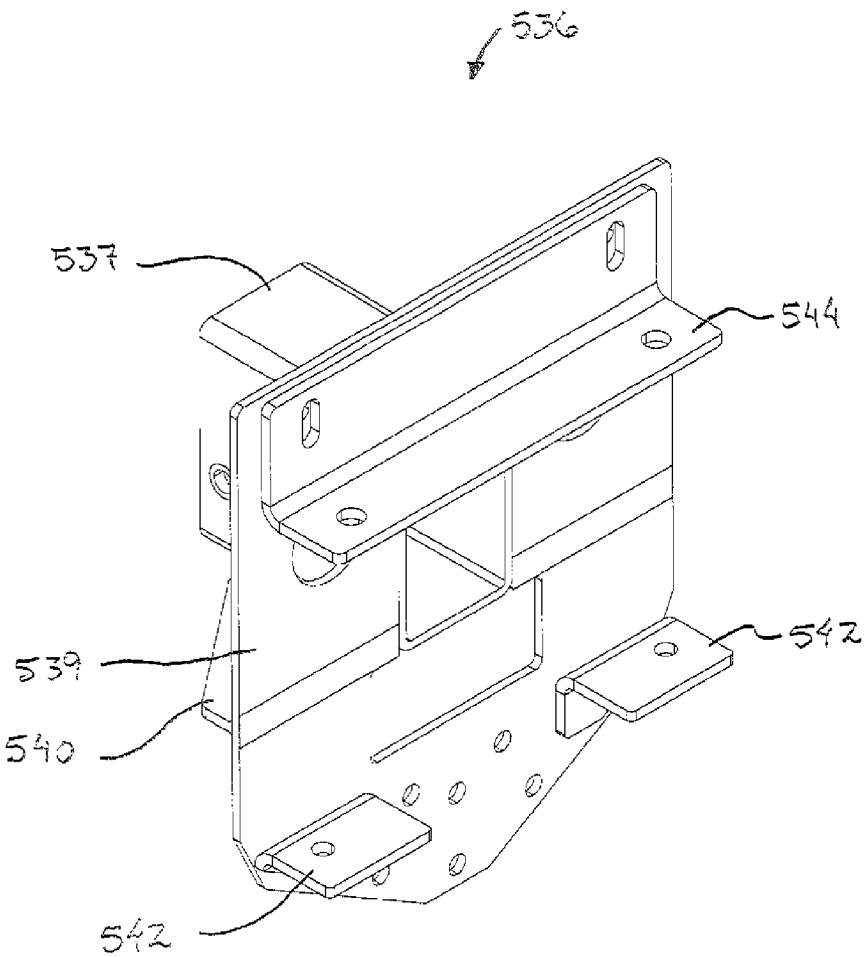
FIG. 17 depicts a perspective view of a cylinder bracket assembly for use with the post of FIG. 16.

Cylinder bracket (537) is connected to base (539) of cylinder bracket assembly (536). However, unlike base (139), described above, base (539) is configured to optionally receive and support overhead bar assembly (600), as will be described in greater detail below. Base (539) securely fastens cylinder bracket assembly (536) to the upper end of post (510) and transfers load to post (510) by resting on top of the upper end of post (510). As can best be seen in FIG. 17, base (539) includes two forward mounting plates (542) and a single rear mounting plate (544). Mounting plates (542, 544) are configured to secure base (539) to post (510) using bolts or other mechanical fasteners. It should be understood, that although base (539) is shown as including mounting plate (542, 544), in other examples base (539) may be secured to post (510) by any other suitable fastening means such as welding, or bracketing of other suitable configurations.

To add additional stability to cylinder bracket assembly (536), two stabilizing plates (540) connect base (539) to cylinder bracket (537). Although stabilizing plates (540) are shown as triangular in shape, they may be of any suitable shape. Additionally, other examples may include more or less stabilizing plates (540), or even omit stabilizing plates (540) entirely. Other suitable configurations for cylinder bracket assembly (536) will be apparent to those of ordinary skill in the art in view of the teachings herein.

Returning to FIG. 16, base (539) includes a support extension (546), which extends over the side of post (510). As will be understood, support extension (546) is configured to support and secure overhead assembly (600) relative to post (510). Support extension (546) comprises a plurality of bolt holes (548), which are configured to secure overhead assembly (600) to base (539) as will be described in greater detail below. As will be understood, bolt holes (548) are arranged in an array to permit mounting of overhead assembly (600) in a variety of orientations. Of course, such an arrangement of bolt holes (548) is entirely optional and in other examples bolt holes (548) may be arranged in any suitable pattern. Additionally, support extension may comprise any suitable number of bolt holes (548) as will be apparent to those of ordinary skill in the art in view of the teachings herein.

Figure 18:
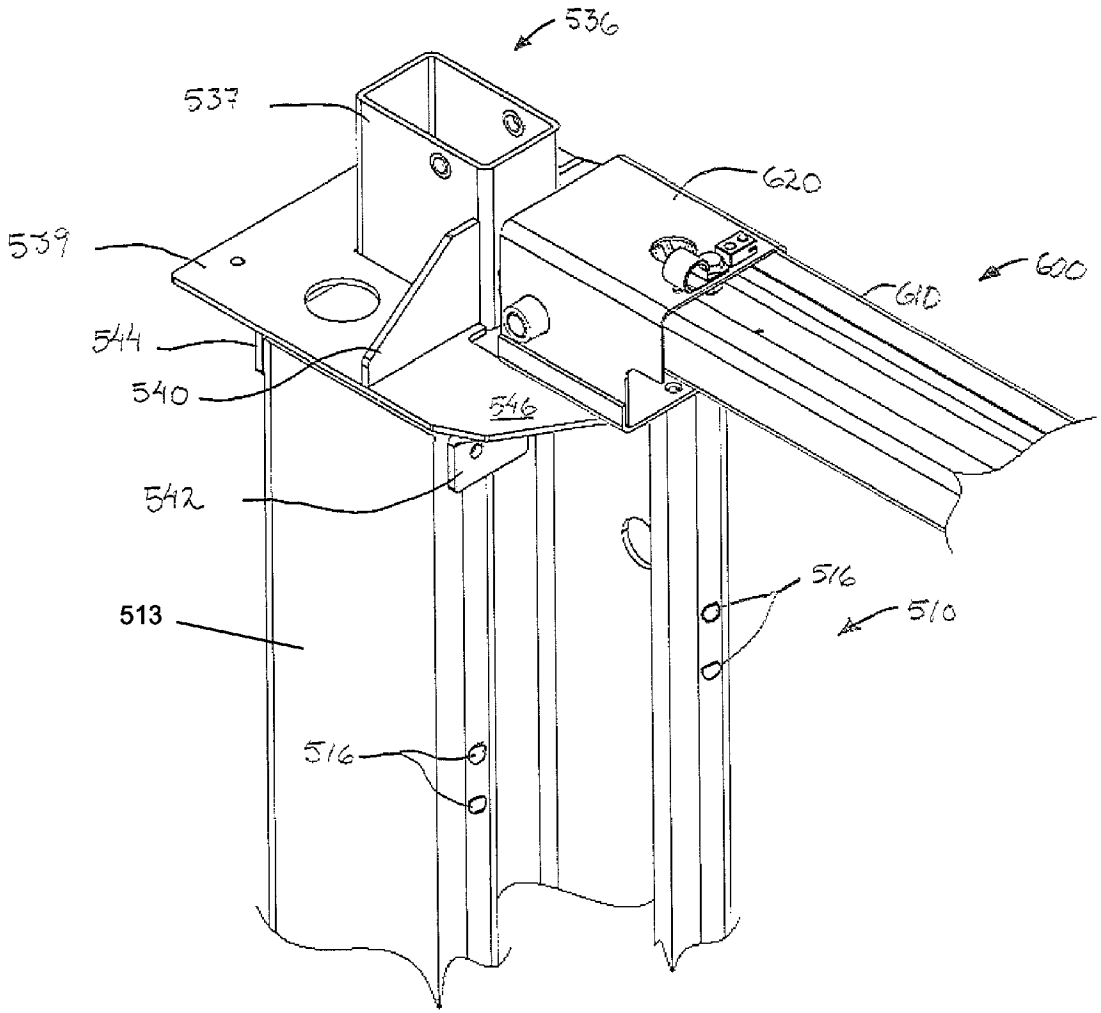
FIG. 18 depicts a perspective view of the post of FIG. 16 with an overhead bar assembly attached, the overhead bar assembly in an upper position.
Figure 19:
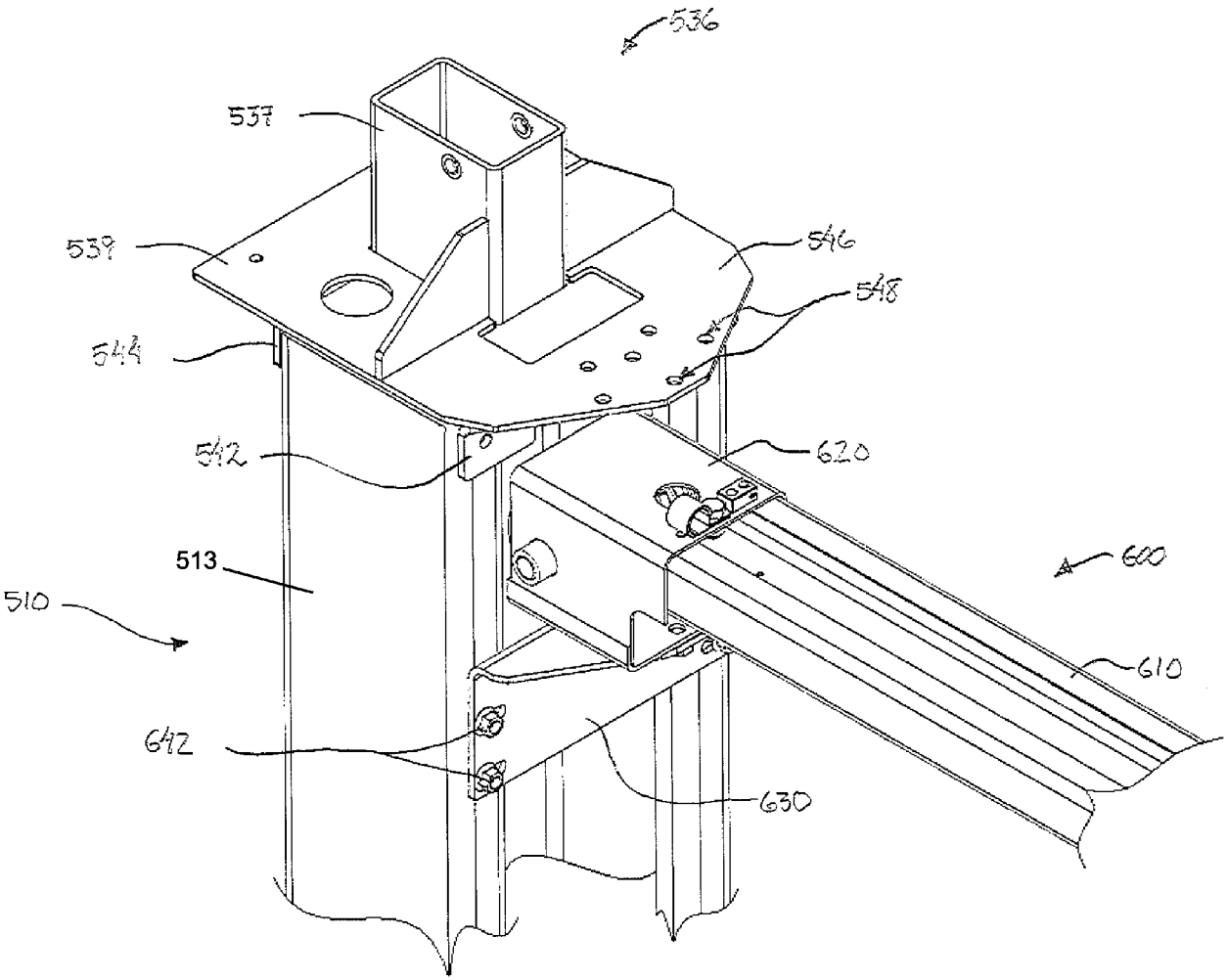
FIG. 19 depicts another perspective view of the post of FIG. 16 with an overhead bar assembly attached, the overhead bar assembly in a lower position.

As described above, support extension (546) is configured to secure and support overhead bar assembly (600) relative to post (510). As can be seen in FIG. 18, overhead bar assembly (600) comprises overhead bar (610), L-bracket (620). It should be understood that overhead bar assembly (600) is substantially the same as overhead bar assemblies (200, 400) described above, except as otherwise noted below. Similar to overhead bar assembly (200), overhead bar assembly (600) may be optionally positioned in an upper position and a lower position. FIG. 18 shows overhead bar assembly (600) positioned in the upper position. In contrast, FIG. 19 shows overhead bar assembly (600) in the lower position. As will be described in greater detail below, when overhead bar assembly (600) is in the lower position, overhead bar assembly (600) may include an overhead bracket (630), which may be substantially similar to overhead bracket (230) described above. However, as shown in FIG. 18, support extension (546) is used instead of overhead bracket (630). Thus, when overhead bar assembly (600) is in the upper position support extension (546) is used to support overhead bar assembly (600), while overhead bracket (630) is used to support overhead bar assembly (600) when overhead bar assembly (600) is in the lower position.

As can be seen in FIG. 18, when overhead bar assembly (600) is in the upper position, L-bracket (620) of overhead bar assembly (600) rests directly on support extension (546) of cylinder bracket assembly (536). Similarly to L-bracket (220) described above, L-bracket (620) may be bolted to support extension (546), thereby securing overhead bar assembly (600) to post (510).

As can be seen in FIG. 19, when overhead bar assembly (600) is in the lower position, L-bracket (620) of overhead bar assembly (600) rests on overhead bracket (630). Similarly to overhead bracket (230) described above, overhead bracket (630) may be bolted to post (510) via bolts (644) and bolt holes (515). L-bracket (620) may then be secured to overhead bracket (630) via bolts to secure and support overhead bar assembly (600) relative to post (510). It should be understood that although a nut and bolt mechanical fastening means is used in the present example to connect overhead bar assembly (600) to post (510), in other examples any other suitable fastening means may be used such as welding, or any other suitable mechanical fastening means.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An apparatus for lifting a vehicle off of a base surface, the apparatus comprising:

(a) a first post assembly vertically extending from the base surface comprising:

(i) a first post with a first fixed effective height comprising:

(A) a bottom end of the first post on the base surface, (B) a first cylinder bracket assembly fixedly secured to a top end of the first post, (C) a first overhead assembly engagement feature located at a first vertical position proximate the top end of the first post, and (D) a second overhead assembly engagement feature located at a second vertical position along the first post, wherein the second vertical position is a fixed, nonzero distance below the first vertical position along the first post; and (ii) a first pull-type actuator secured to the first cylinder bracket assembly on the top end of the first post; and (iii) a first lifting assembly attached to a movable end of the first pull-type actuator opposite the first cylinder bracket assembly, the first pull-type actuator configured to pull the first lifting assembly upwardly along the first post to raise the vehicle and extend to move the first lifting assembly downwardly along the first post to lower the vehicle;

(b) a second post assembly vertically extending from the base surface, comprising:

(i) a second post with a second fixed effective height, comprising:

(A) a bottom end of the second post on the base surface, (B) a third overhead assembly engagement feature located at a third vertical position proximate a top end of the second post, and (C) a fourth overhead assembly engagement feature located at a fourth vertical position along the second post, wherein the fourth vertical position is a fixed, nonzero distance below the third vertical position along the second post, (ii) a second lifting assembly configured to move simultaneously with the first lifting assembly along the second post to raise and lower the vehicle; and (d) an overhead assembly comprising:

(i) an elongated member with a first end and second end, (ii) a first attachment feature at the first end, and (iii) a second attachment feature at the second end, and (e) at least one stabilizing cable passing from the first lifting assembly through the overhead assembly to the second lifting assembly;

wherein the first post assembly and the second post assembly extend vertically parallel to each other, and the overhead assembly is configured to selectively secure to the first post assembly and the second post assembly at a selected one of a first selected fixed height and a second selected fixed height lower than the first selected fixed height, wherein at the first selected fixed height, the first attachment feature is secured to the first overhead assembly engagement feature, and the second attachment feature is secured to the third overhead assembly engagement feature, and the at least one stabilizing cable is configured for operation at the first selected fixed height, and wherein at the second selected fixed height, the first attachment feature is secured to the second overhead assembly engagement feature and the second attachment feature is secured to the fourth overhead assembly engagement feature and the at least one stabilizing cable is configured for operation at the second selected fixed height, and wherein during lifting and lowering operations of the apparatus, the height of the elongated member above the base surface remains fixed.

2. The apparatus of claim 1, wherein the second post assembly further comprises:

(i) a second cylinder bracket assembly fixedly secured to a top end of the second post, (ii) a second pull-type actuator attached to the second cylinder bracket assembly on the top end of the second post; and (iii) the second lifting assembly attached to a movable end of the second pull-type actuator opposite the second cylinder bracket assembly, the second pull-type actuator configured to operably drive the second lifting assembly vertically along the second post to raise and lower the vehicle.

3. The apparatus of claim 2, wherein the overhead assembly is positioned between the posts, wherein the overhead assembly extends perpendicularly relative to the posts.

4. The apparatus of claim 1, wherein the first overhead assembly engagement feature comprises a first hole pattern formed through the first post, wherein the second overhead assembly engagement feature comprises a second hole pattern formed through the first post, wherein the third overhead assembly engagement feature comprises a third hole pattern formed through the second post, wherein the fourth overhead assembly engagement feature comprises a fourth hole pattern formed through the second post.

5. The apparatus of claim 1, wherein the first post base and the second post base are secured to a floor.

6. The apparatus of claim 1, wherein the first pull-type actuator comprises a hydraulic cylinder.

7. The apparatus of claim 6, wherein the hydraulic cylinder is configured to extend to move each respective lifting assembly downwardly.

8. The apparatus of claim 6, wherein the hydraulic cylinder is configured to pull each respective lifting assembly upwardly.

9. The apparatus of claim 1, wherein the first attachment feature of the overhead assembly is secured to the respective overhead assembly engagement feature on the first post using a first overhead bracket comprising a first vertically extending portion and a first horizontally extending portion, and the second attachment feature of the overhead assembly is secured to the respective overhead assembly engagement feature on the second post using a second overhead bracket comprising a second vertically extending portion and a second horizontally extending portion.

10. The apparatus of claim 9, wherein each overhead bracket is attachable to each corresponding post by nut and bolt mechanical fastening.

11. The apparatus of claim 9, wherein each overhead bracket is configured to be selectively movable between the first vertical position or the second vertical position to selectively adjust the height of the overhead assembly relative to the posts.

12. A vehicle lift system for lifting a vehicle off of a base surface, comprising:

(a) a first post assembly extending vertically from the base surface, comprising (i) a first post with a first fixed effective height, comprising (A) a bottom end on the base surface, (B) a first cylinder bracket assembly fixedly secured to a top end of the first post, (C) a first upper attachment feature located at a first vertical position proximate the top end of the first post, and (D) a first lower attachment feature located at a second vertical position along the first post, wherein the second vertical position is a fixed, nonzero distance below the first vertical position along the first post;

(ii) a first pull-type actuator secured to the first cylinder bracket assembly on the top end of the first post; and (iii) a first lifting assembly attached to a movable end of the first pull-type actuator opposite the first cylinder bracket assembly, the first pull-type actuator configured to pull the first lifting assembly upwardly along the first post to raise the vehicle and extend to move the first lifting assembly downwardly along the first post to lower the vehicle; and (b) a second post assembly extending vertically from the base surface, comprising:

(i) a second post with a second fixed effective height, comprising:

(A) a bottom end of the second post on the base surface, (B) a second upper attachment feature located at a third vertical position proximate the top end of the second post, and (C) a second lower attachment feature located at a fourth vertical position along the second post, wherein the fourth vertical position is a fixed, nonzero distance below the third vertical position along the second post, and wherein the first post and the second post are aligned relative to each other and configured to support a vehicle; and (ii) a second lifting assembly configured to move simultaneously with the first lifting assembly along the second post to raise and lower the vehicle; and (c) an overhead assembly comprising an elongated member with a first attachment feature at a first end and a second attachment feature at a second end;

(d) a stabilizing cable passing from the first lifting assembly through the overhead assembly to the second lifting assembly;

wherein the overhead assembly is configured to selectively secure to the first post assembly and the second post assembly either:

(i) at a first selected fixed height by attachment of the first attachment feature to the first upper attachment feature and attachment of the second attachment feature to the second upper attachment feature, or (ii) at a second selected fixed height by attachment of the first attachment feature to the first lower attachment feature and attachment of the second attachment feature to the second lower attachment feature; and wherein during lifting and lowering operation of the system, the height of the elongated member above the base surface remains fixed.

13. The system of claim 12, wherein the first attachment feature comprises a first support member configured to be detached from the rest of the overhead assembly, wherein the second attachment feature comprises a second support member configured to be detached from the rest of the overhead assembly.

14. The system of claim 12, wherein each of the first post and second post has a sidewall; and each of the first upper attachment feature, first lower attachment feature, second upper attachment feature, and second lower attachment feature comprises at least one hole in the sidewall of the respective post.

15. A method for adjusting a height of a vehicle lift system, the vehicle lift system comprising a first post extending vertically from a base surface, a second post extending vertically from the base surface, a first bracket, a second bracket, a pull-type actuator secured to a top end of the first post and configured to lift a vehicle by synchronized movement of a first lifting assembly associated with the first post and a second lifting assembly associated with the second post, a stabilizing cable, and an overhead assembly extending between each post of the pair of posts, the method comprising:

(a) coupling the first bracket at a first position on the first post and the second bracket at a second position on the second post, wherein the first position and the second position together correspond to a first height of the overhead assembly;

(b) coupling the overhead assembly to the first bracket and the second bracket while the first bracket is in the first position and the second bracket is in the second position so that a stabilizing cable in communication with the first lifting assembly and the second lifting assembly passes between the first post and the second post via the overhead assembly;

(c) decoupling the first bracket from the first position and decoupling the second bracket from the second position;

(d) coupling the first bracket at a third position on the first post and coupling the second bracket at a fourth position on the second post, wherein the third position and the fourth position together correspond to a second height of the overhead assembly that is different from the first height;

(e) coupling the overhead assembly to the first bracket and the second bracket while the first bracket is in the third position and the second bracket is in the fourth position so that the stabilizing cable passes between the first post and the second post via the overhead assembly; and (f) adjusting a position at which the cable attaches to the respective lifting assembly.

* * * * *